US006436510B1

(12) United States Patent
Heidel et al.

(10) Patent No.: US 6,436,510 B1
(45) **Date of Patent: *Aug. 20, 2002**

(54) LOW-FLAMMABILITY SHINGLE

(75) Inventors: Peter Heidel; Bertrand Claude Weiter, both of Bobingen (DE)

(73) Assignee: Johns Manville Internationsl, Inc., Denver, CO (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/086,428

(22) Filed: May 28, 1998

(30) Foreign Application Priority Data

May 30, 1997 (DE) ..... 297 09 804 U

(51) Int. Cl.[7] ..... B32B 11/02

(52) U.S. Cl. ..... 428/142; 52/518; 428/143; 428/149; 428/150; 428/920; 428/921

(58) Field of Search ..... 428/143, 142, 428/149, 150, 920, 921; 52/518

(56) References Cited

U.S. PATENT DOCUMENTS

| | | | | | |
|---|---|---|---|---|---|
| 4,234,639 | A | * | 11/1980 | Graham | 428/144 |
| 5,171,629 | A | * | 12/1992 | Heidel et al. | 442/383 |
| 5,307,604 | A | * | 5/1994 | Tasso | 52/745.19 |
| 5,616,395 | A | * | 4/1997 | Baravian et al. | 428/102 |
| 5,666,776 | A | * | 9/1997 | Weaver et al. | 52/557 |

* cited by examiner

*Primary Examiner*—Harold Pyon
*Assistant Examiner*—Sandra M. Nolan
(74) *Attorney, Agent, or Firm*—Burns, Doane, Swecker & Mathis, LLP

(57) ABSTRACT

The present invention relates to a low-flammability shingle comprising at least one double-sidedly bituminized textile sheet material to whose surface has been applied a pulverulent or flaky flame protectant at least single-sidedly, and to roofs comprising these shingles.

21 Claims, No Drawings

LOW-FLAMMABILITY SHINGLE

The invention relates to a low-flammability shingle and to roofs and roof surfaces made thereof.

Low-flammability shingles have to meet a diversity of requirements. This is achieved by the shingles having a multilayered construction. Known low-flammability shingles which essentially meet the requirements have a laminatelike construction involving a plurality of discrete specialty bitumen and glass fiber web layers. There are also low-flammability shingles which comprise just one heavyweight glass web inliner, so that the above-described multilayered construction is simplified. The aforementioned heavyweight glass web inliners customarily have a basis weight of at least 100 g/m$^2$. The above-described laminatelike construction or the heavyweight glass web inliner provide the shingle, on the one hand, with adequate mechanical stability and, on the other, with high resistance to flying brands and radiant heat.

As well as these properties, low-flammability shingles have to have high form stability, so that they stay free of any deformations which would result in roof leaks even after prolonged use.

Previously known low-flammability shingles either have a laminatelike construction involving discrete specialty bitumen and glass fiber web layers which is relatively costly to realize, or else they comprise heavyweight glass web inliners, which are relatively costly. A further disadvantage is that bitumen adhesion on glass fiber webs is not a straightforward matter. Furthermore, delamination cannot be ruled out, given the different physical properties of the individual layers. In addition to the above-described advantages, it is desirable that the shingles have a high nail pullout resistance, since they are customarily secured on the roof structure by nails.

It is an object of the present invention to provide further—simple-to-realize—low-flammability shingles which, on the one hand, meet the fire protection requirements of fire protection standard DIN 4102 Part 7 and fire protection standard "Nordtest Method No. 6" and, on the other, possess adequate nail pullout resistance. Furthermore, the shingle of the invention shall possess high delamination resistance and improved bitumen adhesion. A further requirement—for economic reasons—is the omission of a relatively costly glass fiber web inliner.

The present invention accordingly provides a low-flammability shingle comprising at least one double-sidedly bituminized textile sheet material to whose surface has been applied a pulverulent or flaky flame protectant at least single-sidedly.

The term "textile sheet material" is herein used in its widest sense. It encompasses all structures formed from natural or synthetic fibers, especially from synthesized polymer fibers, by a sheet-forming technique. Examples of such structures are wovens, consecutive course formation knits and preferably laids, simultaneous course formation knits and nonwovens.

Natural fibers are especially wool, cotton, flax, sisal, coir and/or cellulose fibers.

Fibers means not only fibers of finite length, i.e., staple fibers, but also continuous filament fibers.

If the textile sheet material is constructed from synthetic staple fibers, these consist of the same material as the below-described spunbonded web nonwovens.

Of the webs constructed of fibers composed of synthetic polymers, spunbonded webs, also known as spunbonds, which are produced by random laydown of freshly meltspun filaments, are preferred. They consist of continuous filament synthetic fibers composed of melt-spinnable polymer materials. Suitable polymer materials include, for example, polyamides, e.g., polyhexamethylenediadipamide, polycaprolactam, wholly or partly aromatic polyamides ("aramids"), partly or wholly aromatic polyesters, polyphenylene sulfide (PPS), polymers having ether and keto groups, e.g., polyetherketones (PEKs) and polyetheretherketone (PEEK), or polybenzimidazoles.

The spunbonded webs preferably consist of melt-spinnable polyesters. The polyester material can in principle be any known type suitable for fibermaking. Such polyesters consist predominantly of building blocks derived from aromatic dicarboxylic acids and from aliphatic diols. Commonly used aromatic dicarboxylic acid building blocks are bivalent radicals of benzenedicarboxylic acids, especially of terephthalic acid and of isophthalic acid; commonly used diols have 2 to 4 carbon atoms, and ethylene glycol is particularly suitable. Composites of the invention whose webs consist of a polyester material which is at least 85 mol % polyethylene terephthalate are particularly advantageous. The remaining 15 mol % are then composed of dicarboxylic acid units and glycol units, which act as modifiers, so-called, and which enable the person skilled in the art to adjust the physical and chemical properties of the product filaments in a controlled manner. Examples of such dicarboxylic acid units are the radicals of isophthalic acid or of aliphatic dicarboxylic acid such as, for example, glutaric acid, adipic acid, sebacic acid; examples of modifying diols radicals are those of diols having longer chains, for example of propanediol or butanediol, of di- or triethylene glycol or, if present in a small amount, of polyglycol having a molecular weight of about 500 to 2000.

In addition, polyesters which have been modified to be flame-inhibiting can also be used. Such polyesters are described for example in DE-A-3,940,713 and are commercially available under the name of ®TREVIRA CS or ®REVIRA FR (Hoechst AG). The polyesters are not subject to any restriction as regards their flame-inhibiting modification.

Particular preference is given to polyesters comprising at least 95 mol % of polyethylene terephthalate, especially those composed of unmodified polyethylene terephthalate.

The polyesters in the nonwovens customarily have a molecular weight corresponding to an intrinsic viscosity (IV) of 0.5 to 1.4 (dl/g), measured on solutions in dichloroacetic acid at 25° C.

The synthetic polymer fiber textile sheet materials for producing the shingle of the invention have basis weights of 20 to 2000 g/m$^2$, preferably 50 to 400 g/m$^2$.

After production, the webs are consolidated mechanically, for example by needling, or thermally by calendering at elevated temperature and pressure and/or chemically, for example by means of fusible binders which are preferably introduced in fiber form.

In a further embodiment of the invention, the synthetic polymer fiber textile sheet material can also be a nonwoven which has been consolidated by means of a fusible binder, said nonwoven comprising loadbearing and binder fibers. The loadbearing and binder fibers can be derived from any desired thermoplastic fiber-forming polymers in line with the user's requirements profile. The relative proportion of the two fiber types can be selected within wide limits, although care has to be taken to ensure that the proportion of the binder fibers is sufficiently high for the nonwoven fabric to acquire a strength which is sufficient for the desired application as a result of the loadbearing fibers being adhered together by the binder fibers. The proportion of nonwoven accounted for by the binder due to the binder fiber is customarily less than 50% by weight, based on the weight of the nonwoven fabric.

Suitable fusible binders include especially modified polyesters having a melting point which is up to 50° C., preferably 10 to 50° C., especially 30 to 50° C., lower than that of the nonwoven raw material. Examples of such a binder are polypropylene, polybutylene terephthalate, and polyethylene terephthalate modified through incorporative cocondensation of longer-chain diols and/or of isophthalic acid or aliphatic dicarboxylic acids. The fusible binders are preferably introduced into the webs in fiber form, especially in such a way that at least one surface, generally the surface which is to be finished with the flame and/or fire protection materials, consists virtually completely of binder fibers, as described in EP-A-0530769. The fiber linear densities of the loadbearing fibers and of the binder fibers are customarily within the range from 1 to 16 dtex, preferably within the range from 2 to 6 dtex.

In a further embodiment, the webs which have been mechanically consolidated by needling and/or by means of fluid jets can optionally be end-consolidated by means of a chemical binder, for example a chemical binder based on a polyacrylate.

Particular preference is given also to those textile sheet materials which comprise a combination of preferred features.

The filaments or staple fibers of the nonwoven fabrics can have a virtually round cross section or else other shapes, such as dumbbell-shaped, kidney-shaped, triangular or tri- or multilobal cross sections. It is also possible to use hollow fibers. Furthermore, the binder fiber can also be used in the form of bicomponent fibers or in the form of fibers constructed from more than two components, in which case it has to be ensured that the binder is available for consolidation. In the case of core-sheath bicomponent fibers, this means that the sheath component is essentially composed of the fusible binder.

The filaments forming the spunbonded web may be modified by customary additives, for example by antistats, such as carbon black and/or hydrophobicizers.

The shingle of the invention advantageously comprises at least one spunbonded web of the above-described kind as textile sheet material. Such a shingle has high nail pullout resistance. In addition, the shingle of the invention may also comprise a plurality of textile sheet materials.

The shingle of the invention further comprises a pulverulent or flaky flame protectant applied to at least one side of the textile sheet. The flame protection materials used are conventional intumescent and/or gas-evolving flame protectants. Such flame or fire protection materials are or comprise in particular:

(i) graphite and/or graphite compounds, for example ®Sigraflex, which, on heating, expands and/or releases fire-inhibiting gases (intumescence effect) and/or (ii) phosphorus-nitrogen compounds, such as ammonium phosphates and polyphosphates, which are available under the trade name of ®Exolith, and/or (iii) carbon donor compounds, for example starch plus pentaerythritol, optionally plus phosphorus-nitrogen compound(s), e.g., dicyandiamide and/or diammonium phosphate;

(iv) red phosphorus which is present in a free-flowing pastille form and optionally comprises phosphates and waxes. Examples thereof are commercial products such as ®Hostaflam RP 681, 682 and 683.

The aforementioned graphite compounds are in particular graphite salts, i.e., compounds of graphite and mineral acids, such as nitric acid or sulfuric acid.

The flame protection materials used according to the invention, as well as the aforementioned compounds, may comprise further additives, for example aluminum hydroxides. The properties of the flame protectant can be influenced in a controlled manner through the choice of additive and quantity added.

The flame or fire protection material is applied at least single-sidedly to the textile sheet material in an amount which is preferably within the range from 10 to 120 g/m$^2$, particularly preferably in an amount within the range from 20 to 80 g/m$^2$.

It is particularly advantageous for the flame protectant to have an average particle size within the range from 150 to 650 $\mu$m (D 50% value), since this makes it possible to achieve a particularly uniform dispersion.

The flame protectant is fixed on the textile sheet material by means of a binder. This can be a chemical binder and/or a fusible binder or a resin. Suitable binders are for example polyvinyl alcohol solutions, solutions of starch, cellulose or derivatives thereof. Polymeric binders are for example rubber, latex, polyolefins such as polyethylene or polypropylene, polyvinyl acetate, polyurethane, polyacrylate, polystyrenebutadienes, copolymers based on polyvinyl acetate, acrylate/styrene, ethylene/vinyl acetate and halogen-containing polymers. Suitable fusible binders are hotmelt adhesives based on polyamide, polyester or polyurethane, copolymers thereof and mixtures thereof. Of these fusible binders, it is especially polybutylene terephthalate and modified polyethylene terephthalates (using aliphatic dicarboxylic acids or isophthalic acid) which are suitable. Suitable resins are fusible melamine-formaldehyde precondensates which can condense to form thermosets.

The polymeric binders and the hotmelt adhesives can be applied in the form of discrete particles, powders, granules, staple fibers, continuous filament fibers, film or as textile sheet material and also as melt.

It is an important requirement that the hotmelt adhesive or the polymeric binder have a sticking temperature which is below the softening temperature of at least the loadbearing fibers of the textile sheet material. If the synthetic polymer fiber textile sheet material is a nonwoven fabric consolidated by means of a fusible binder, the softening temperatures of the fusible polymer and of the binder fibers of the fusible binder consolidated nonwoven fabric can also be almost identical or even overlap.

If the textile sheet material comprises a proportion of fibers which can act as fusible binder, it is of particular advantage for these fibers to be arranged as described in detail in EP-A-0,530,769. These adhesive fibers can also be present in the form of bicomponent or heterofil fiber.

In addition, the flame protectant can also be incorporated in the bitumen and be applied together with it. However, this has the disadvantage that only a small amount of the flame protectant can become active and thus the consumption of flame protectant is disproportionately higher. Nevertheless, this variant offers a processing advantage, especially in relation to favorable flame protectants, since a process step can be omitted. It is an essential requirement, however, that, in this variant, the flame protectant be incorporated in an amount of up to 20%, especially 5 to 10%, based on the product weight of the finished shingle.

Furthermore, the flame protectant can be applied in the form of a dispersion or suspension together with the optionally liquefied binder.

The amount of binder required to fix the flame protectant depends essentially on the type of binder. If the binder is a fusible polymeric binder, it is applied to the textile sheet material in an amount within the range from 5 to 120 g/m$^2$, particularly preferably in an amount within the range from 10 to 40 g/m$^2$, at least single-sidedly Subsequently, the textile sheet material loaded with the flame protection material and the binder is subjected to heat and/or pressure, so that the flame protection material adheres to the upper surface of the textile sheet material.

In a further embodiment, the low-flammability shingle of the invention can further comprise reinforcing layers. These can further increase the dimensional stability of the finished shingle. The reinforcing layer can have the further function of stabilizing the textile sheet material of which the shingle of the invention essentially consists during bituminization. These reinforcing layers are individual threads in an essentially parallel arrangement having a thread count between 0.1 and 10 threads per cm, or wovens, consecutive course formation knits, laids, simultaneous course formation knits and nonwovens, especially wovens and laids, composed of high performance filaments, for example glass, carbon, aromatic amides (aramids) and polyester, preferably glass. The reinforcing layers are preferably arranged in the form of a woven or laid fabric, the thread count being between 0.1 and 10 threads per cm.

The textile sheet material finished with flame protectant is subsequently bituminized on both sides in a conventional manner. The bitumen used can be any bitumen or polybitumen suitable for producing roofing membranes.

In addition, the shingle of the invention can have a covering layer composed of an abrasion-resistant particulate material, for example granules or sand.

The shingles of the invention are obtained from a thus-produced membrane by stamping out. The shape of the shingles is not subject to any restriction, but classic shapes such as flat shingles are preferred for aesthetic reasons. The stamped-out shingle can be present as individual shingles or as shingle membrane. A shingle membrane, which results from the choice of stamping tool, is a strip of a plurality of contiguous shingles which are still connected to each other. Such shingle shapes are described in detail for example in product data sheets for ICOPAL shingles (Icopal-Siplast GmbH, Germany).

The shingle of the invention can comprise one or more textile sheet materials, in which case at least one textile sheet material must have a flame-inhibiting finish to ensure the required low flammability. Depending on the basis weight of the textile sheet, just one flame-inhibitingly finished textile sheet material may be sufficient to obtain, after bituminization and optional be sprinkling with sand and/or granules, a shingle which meets the requirements. In this case, the basis weight of the unfinished textile sheet should be at least 100 g/m$^2$. In special cases, a heavyweight textile sheet can be replaced by a plurality of lighter textile sheets, so that, in total, a shingle of higher strength is obtained.

This particular embodiment of the invention consists of a laminatelike construction, i.e., when the shingle is constructed of a plurality of double-sidedly bituminized textile sheet materials, which construction can comprise not only textile sheet materials finished with flame protectants but also unfinished textile sheet materials. This sandwichlike construction is particularly preferred when a particularly high nail pullout resistance and mechanical stability is required. In a further embodiment, this construction can additionally comprise a reinforcing layer.

The low-flammability shingle of the invention has a thickness between 1 and 50 mm, in particular 2 and 10 mm. The basis weight of the bituminized shingle of the invention is between 1 and 40 kg/m$^2$, in particular between 2 and 8 kg/m$^2$.

The low-flammability shingle of the invention can be used to produce roofs and roof surfaces.

The shingle of the invention has low flammability and meets the fire protection requirements of the fire protection performance of DIN 4102 Part 7 and Nordtest Method No. 6.

Improved processibility for the low-flammability shingle is obtained in a conventional manner when a portion which corresponds to a jointing or a butting region of the finished shingle is kept free of flame protection material, since a bond can be created here without any risk of activating the flame or fire protection material. The processibility can be further improved by applying a fusible protective film to the undersurface of the finished shingle. This fusible protective film inhibits a sticking together of the shingles during storage and transportation and can be removed, if necessary, by means of a torch. This is necessary especially along all abutments and connecting points, since this is where a shingle adhesive is customarily applied.

The shingles are laid using laying techniques familiar to the person of ordinary skill in the art and is not subject to any restrictions whatsoever.

The present invention further provides a process for producing the low-flammability shingle of the invention, said process comprising the measures of:

a) forming a textile sheet, b) applying the binder, c) applying the flame protectant, d) exerting elevated temperature and/or pressure to adhere the flame protectant to the surface of the textile sheet, e) bituminizing the sheet obtained as per measure d), f) fabricating the shingle from the membrane obtained as per measure e), the process being characterized in that the flame protectant is pulverulent or flaky.

A preferred way to form the textile sheet as per measure a) is spinbonding. The formation of the textile sheet can optionally be followed by a preconsolidation of the textile sheet formed.

In a variant of the process, it is possible to incorporate at least one reinforcing layer in a conventional manner before or after measures a), b) or c).

In a variant of the process, it is possible to carry out measures b) and c) conjointly.

In a variant of the process, it is possible to combine a plurality of product membranes obtained as per measure e). This allows, inter alia, the shingle to be constructed in the form of a laminate in which textile sheet materials which have not been finished with flame protectants can be combined with finished textile sheet materials.

Under measure c) of the process, the pulverulent flame protectant can also be applied by a plurality of successively disposed be sprinkling units, in which case the order of application is not subject to any restriction.

The bituminizing of measure e) is effected by saturating the product membrane with bitumen, for example by soaking (bitumen bath) or bothsided coating. Such bituminizing processes are known in the manufacture of roofing membranes.

Subsequently the bituminized product membrane can be besprinkled with a decorative top layer, for example finely particulate sand or optionally colored granules. The besprinkling is advantageously effected onto the still soft bitumen layer shortly after the bituminizing step. To prevent the fabricated shingles from sticking together, it is advantageous to apply to the undersurface of the product membrane obtained as per measure e) a fusible protective film which can be easily removed if necessary.

Subsequently the product membrane is fabricated, i.e., the shingles of the invention are obtained by stamping out, sawing out or other suitable measures.

It is equally preferable to interrupt the process after the sheet-forming step or at a later suitable time.

The low-flammability shingles obtained can be used directly as covering for roof surfaces. Such roofs or roof surfaces produced using the shingles of the invention likewise form part of the subject-matter of the present invention.

What is claimed is:

1. A low-flammability shingle having an upper surface and an under surface that meets fire protection requirements comprising at least one double-sidedly bituminized textile sheet material consisting of synthetic spunbonded nonwoven thermoplastic polymeric fibers wherein a pulverulent or flaky flame protectant has been adhered only to the surface of said textile sheet material in a concentration of 10 to 120 g/m$^2$ prior to bituminizing said textile sheet material with bitumen that lacks the inclusion of a flame protectant and with said pulverulent or flaky flame protectant being provided as a layer intermediate said textile sheet material and said bitumen.

2. The shingle of claim 1, wherein the spunbonded nonwoven thermoplastic textile sheet material has been consolidated thermally, chemically or by means of a fusible binder.

3. The shingle of claim 1, wherein the spunbonded nonwoven thermoplastic textile sheet material is a polyester.

4. The shingle of claim 1, wherein the textile sheet material has a basis weight of 20 to 2000 g/m$^2$.

5. The shingle of claim 4, wherein the textile sheet material has a basis weight of 50 to 400 g/m$^2$.

6. The shingle of claim 1, wherein the flame protectant comprises intumescent graphite, an intumescent graphite compound, a phosphorus-nitrogen compound, a carbon donor composition or red phosphorus, optionally mixed with aluminum hydroxides.

7. The shingle of claim 1, wherein said pulverulent or flaky flame protectant has been adhered only to the surface of said textile sheet material in an amount of 20 to 80 g/m$^2$.

8. The shingle of claim 1, wherein the flame protectant is fixed by a binder.

9. The shingle of claim 8, wherein the binder is a chemical binder, a fusible binder or a resin.

10. The shingle of claim 8, wherein the binder is applied in the form of dispersions, emulsions, discrete particles, powders, granules, staple fibers, continuous filament fibers, film, textile sheet material or as melt.

11. The shingle of claim 1, comprising at least one further reinforcing layer.

12. The shingle of claim 1, having a top layer composed of an abrasion-resistant material.

13. The shingle of claim 1, having a fusible protective film on the under surface.

14. The shingle of claim 1, having a layered construction.

15. The shingle of claim 14, comprising at least one further textile sheet material.

16. The shingle of claim 1, having a thickness of 1 to 50 mm.

17. The shingle of claim 16, having a thickness of 2 to 10 mm.

18. The shingle of claim 1, having a basis weight of 1 to 40 kg/m$^2$.

19. The shingle of claim 18, having a basis weight of 2 to 8 kg/m$^2$.

20. A roof surface comprising at least one shingle as claimed in claim 1.

21. A low-flammability shingle having an upper surface and an under surface that meets fire protection requirements comprising at least one double-sidedly bituminized textile sheet material consisting of synthetic spunbonded nonwoven thermoplastic polyethylene terephthalate fibers wherein a pulverulent or flaky flame protectant has been adhered only to the surface of said textile sheet material in a concentration of 10 to 120 g/m$^2$ prior to bituminizing said textile sheet material with bitumen that lacks the inclusion of a flame protectant and with said pulverulent or flaky flame protectant being provided as a layer intermediate said textile sheet material and said bitumen.

* * * * *